US009795235B1

(12) United States Patent
Bouse

(10) Patent No.: US 9,795,235 B1
(45) Date of Patent: Oct. 24, 2017

(54) DISPOSABLE BEVERAGE CONTAINER SLEEVE

(71) Applicant: Roy Bouse, Pt Bolivar, TX (US)

(72) Inventor: Roy Bouse, Pt Bolivar, TX (US)

( * ) Notice: Subject to any disclaimer, the term of this patent is extended or adjusted under 35 U.S.C. 154(b) by 0 days.

(21) Appl. No.: 15/294,617

(22) Filed: Oct. 14, 2016

(51) Int. Cl.

| | |
|---|---|
| ***A47G 23/02*** | (2006.01) |
| ***B65D 81/38*** | (2006.01) |
| ***B65D 25/20*** | (2006.01) |
| ***B65D 5/42*** | (2006.01) |
| ***B65D 5/72*** | (2006.01) |

(52) U.S. Cl.
CPC ..... *A47G 23/0216* (2013.01); *B65D 5/4266* (2013.01); *B65D 5/725* (2013.01); *B65D 25/205* (2013.01); *B65D 81/3876* (2013.01)

(58) Field of Classification Search
CPC ..... A45F 2200/0583; A47G 23/0216; A61J 1/16; B65D 3/00; B65D 3/04; B65D 3/22; B65D 3/28; B65D 5/4266; B65D 5/725; B65D 25/20; B65D 25/205; B65D 81/3876
USPC ..... 220/737–740, 903; 229/4.5, 104, 117.06, 229/400, 403; 206/215, 449
See application file for complete search history.

(56) References Cited

U.S. PATENT DOCUMENTS

| | | | | |
|---|---|---|---|---|
| 6,059,140 | A * | 5/2000 | Hicks | B65D 81/3879 220/739 |
| 6,412,686 | B1 * | 7/2002 | Mahl | B65D 5/0281 220/738 |
| 6,513,704 | B1 * | 2/2003 | Perot | B65D 5/0209 229/117.06 |
| 8,627,982 | B2 * | 1/2014 | Selina | B65D 81/3876 220/738 |
| 9,125,505 | B2 * | 9/2015 | Morris | A47G 23/0216 |
| 2003/0111475 | A1 * | 6/2003 | Cheng | B65D 81/3876 220/739 |
| 2008/0041864 | A1 * | 2/2008 | Wong | B65D 81/3865 220/738 |
| 2015/0291313 | A1 * | 10/2015 | Vara | B65D 23/085 220/737 |

* cited by examiner

*Primary Examiner* — Bryon Gehman
(74) *Attorney, Agent, or Firm* — Karen B. Tripp

(57) ABSTRACT

A disposable beverage container sleeve has a substantially rectangular upper body and a gusset. The upper body has a vertical upper body fold line and an integrated upper body flap along a first vertical edge of the upper body. The upper body flap is adapted to fold over a second vertical edge of the upper body and is affixed to the upper body proximate the second vertical edge. The gusset is formed from a first gusset portion and a second gusset portion, the first and second gusset portions being integrated with and depending from a lower edge of the upper body on opposing sides of the vertical upper body fold line. The gusset further comprises a gusset support band formed by at least one thickness of the first gusset portion and at least one thickness of the second gusset portion.

17 Claims, 6 Drawing Sheets

DISPOSABLE BEVERAGE CONTAINER SLEEVE

FIELD OF THE INVENTION

The present relates to the field of devices for holding a beverage container, and in particular to devices for shielding a user from temperature and condensate on the exterior of the beverage container.

BACKGROUND OF THE INVENTION

Many people enjoy cold beverages from a can or a bottle when they are travelling, attending or participating in a social activity, sporting event or some other activity. In some cases, it may not be convenient to find a cup or glass of ice to pour the beverage into. In other cases, beverages do not mix well with ice cubes, and sometimes, the quality of the ice may be in question. Still further, ice may not be readily available. People enjoying cold beverages often desire to shield their hands and/or fingers from colder temperature of the beverage container and/or any condensate that may form on the beverage container in warmer and/or more humid ambient environments.

Several devices for insulating a hot or cold beverage are described in patent literature. For example, WO97/32797A1 (Norrish) describes a wrap that is rectangular in shape. In use, a beverage can is laid on its side and rolled on the top of a stack of wraps. A strip of adhesive tape at point of use is used to hold the wrap in place around the can. Similarly, US20020179617A1 (Barthlow et al) describes a wrap-around device made from a water repellent styrene foam and an inner layer of an adsorbent material with an adhesive strip for holding the wrap in place. US20070051736A1 (Tavares) and US20090242578A1 (Bonilla) likewise describe an insulator for a chilled beverage container. The Tavares insulator is formed of two layers with a plurality of air-filled cavities between the layers. The insulator is wrapped around a container, though it is not clear if the insulator is affixed in position. The Bonilla insulator has a multilayer paper towel-like material with an exterior thin metallic foil layer. And finally, US20150291313A1 (Vara) illustrates a rectangular wrap with an overlapping tab portion for applying adhesive.

U.S. Pat. No. 5,746,372A (Spence) describes a beverage holder made of water soluble starch based material for holding a beverage cup, for example a cup containing hot coffee. The holder is arcuate in shape to accommodate a cup that has a tapered diameter. The holder has a tab on one side and a slot for receiving the tab on the other side. Likewise, US20050121457A1 (Wilson et al) and US20080164270A1 (Puerini et al) describe frusto-conical shaped wraps for adsorbing and/or collecting condensate from the outside of a beverage container.

All of devices described above have no bottom section and most of the devices require either the person using the wrap or a person serving the beverage to manipulate the wrap at the point of use for sealing it around the beverage container.

US20060131315A1 (DeGrazio) describes a sheath made from a paper-like fiber that is pressed into a cylindrical shape with pleated sides. An elastic or fixed rim is formed at the top for folding over the top and affixed in place with adhesive. Similarly, US20070205204A1 (Novak) shows a pleated cuff with a top edge for catching drips, spills or condensation.

US20130075412A1 (Schminke) describes an insulated wrap around sleeve with a built-in coaster for adding structure and stability to the insulated drink sleeve.

U.S. Pat. No. 6,290,991B1 (Bell) relates to a collapsible beverage container holder made from a die-cut sheet of recycled pressed paper pulp. The holder has a large rectangular side portion and a small rectangular side portion connected by a substantially circular bottom portion having flanges connecting to the respective opposing rectangular sides. The large rectangular side has opposing side flaps for folding around and affixing to the small rectangular side, for example with adhesive. Similarly, GB2474858A (Jones) describes a blank of insulated paper-based material with a central circular section and a pair of opposing wings, one wing having flaps for folding and adhering to the other wing section. And U.S. Pat. No. 9,302,815B2 (Shaw et al) relates to a paper wrap for a wine bottle. The wrap has a bottom strip attached to the main wrap body to allow for inspection of the contents of the bottle without removing the main wrap body. In a similar approach, US20060283868A1 (McDonald) relates to a beverage container accessory made from a pliable material. A sheet of material is cut into first and second square sections that are affixed with adhesive. Once affixed, the accessory is imprinted with a logo or promotional material.

There is a need for a device that can be readily implemented by a user or a person serving a beverage to a user, and that is flexible for conforming to the diameter of the beverage container, while providing additional strength to the device.

SUMMARY OF THE INVENTION

According to one aspect of the present invention, there is provided a disposable beverage container sleeve, comprising: a substantially rectangular upper body having a vertical upper body fold line and an integrated upper body flap along a first vertical edge of the upper body, the upper body flap adapted to fold over a second vertical edge of the upper body, the upper body flap further adapted to be affixed to the upper body proximate the second vertical edge; a gusset comprising a first gusset portion and a second gusset portion, the first and second gusset portions integrated with and depending from a lower edge of the upper body on opposing sides of the vertical upper body fold line; wherein the gusset further comprises a gusset support band formed by at least one thickness of the first gusset portion and at least one thickness of the second gusset portion.

BRIEF DESCRIPTION OF THE DRAWINGS

The present invention will be better understood by referring to the following detailed description of preferred embodiments and the drawings referenced therein, in which.

DETAILED DESCRIPTION OF THE INVENTION

The present invention provides a disposable sleeve for beverage containers, including, without limitation, cans, glass bottles, metal bottles, plastic bottles, and the like. The disposable sleeve shields a user from temperature and condensate when holding a cold or cool beverage container, particularly in a warmer and/or more humid ambient environment.

Figure 1:
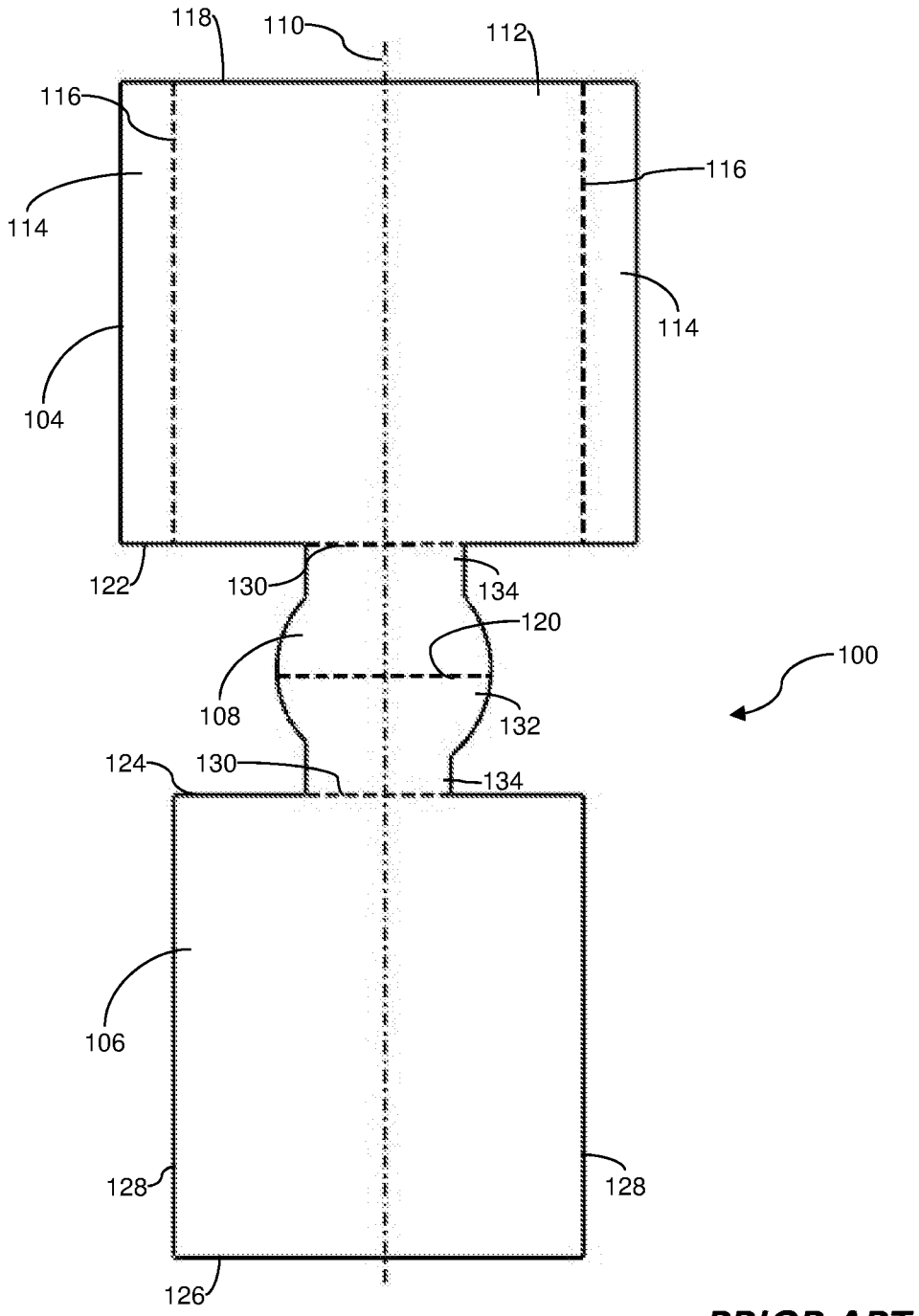
PRIOR ART FIG. 1
FIG. 1 is a top plan view of a blank used to form a beverage container holder in the prior art, as described in U.S. Pat. No. 6,290,091B1 (Bell) and is derived from FIG. 6 of the Bell patent.

In order to more fully appreciate the present invention, reference is first made to FIG. 1, showing a prior art device as described in U.S. Pat. No. 6,290,091B1 (Bell). FIG. 1 and the description in the following five paragraphs are derived from FIG. 6 and the related discussion in the Bell patent.

FIG. 1, depicting PRIOR ART, is a top plan view of a blank 100 used to form the beverage container holder of the Bell patent. The blank 100 comprises a larger rectangular side 104 and a smaller rectangular side 106 connected by a bottom portion 108. A centerline 110 is defined as the line running through larger and smaller sides 104, 106 and the bottom portion 108, dividing the blank 100 into two mirror-image halves.

The larger and smaller sides 104, 106 have identical vertical dimensions, i.e. the dimensions in the direction of the centerline 110. However, the larger side 104 has a larger horizontal dimension, i.e. the dimension in the direction perpendicular to the centerline 110. The larger side 104 comprises a center panel 112 and two opposing glue flaps 114. The glue flaps 114 are separated from the center panel 112 by vertical fold lines 116 extending from a top edge 118 of the larger side 104 to a bottom edge 122 and parallel to the centerline 110. The center panel 112 has the same vertical and horizontal dimensions as the smaller side 106. Thus, the area of the larger side 104 exceeds that of the smaller side 106 by an amount equal to the area of the two glue flaps 114. The smaller side 106 has a top edge 124 away from the bottom portion 108, a bottom edge 126 opposite the top edge 124, and side edges 128. The larger side 104 and the smaller side 106 cooperate to form the substantially cylindrical side of Bell's beverage container holder.

The bottom portion 108 has a substantially circular section 132 connected to the larger and smaller sides 104, 106 by flanges 134. The substantially circular section 132 is shaped to conform to the shape of the bottom of the beverage container, but may be rectangular or hexagonal. The bottom portion 108 has a diameter less than the diameter of the beverage container that is to be held in the assembled holder, but large enough to support the beverage container. A transverse fold line 120 intersects the center point of the bottom portion 108 perpendicular to the centerline 110 to facilitate folding.

The flanges 134 of the bottom portion 108 are connected to the larger and smaller sides 104, 106 along peripheral fold lines 130. The peripheral fold lines 130 are co-linear with the bottom edges of the larger and smaller sides 104, 106 and, along with the edges 122, 124, form the substantially circular bottom periphery of Bell's beverage container when open for use. The fold lines 116, 120, 130 may be either perforated or slit scored to facilitate easier folding.

Bell's beverage container holder is assembled by folding the blank 100 along peripheral fold lines 130 and along transverse fold line 120 so as to bring the larger and smaller sides 104, 106 together in facing relationship, with the bottom 108 interposed between the larger and smaller sides 104, 106. At the same time, the glue flaps 114 are folded inward along vertical fold lines 116 and glued to the inside wall of the smaller side 106.

The present invention provides a disposable sleeve for beverage containers, including, without limitation, cans, glass bottles, metal bottles, plastic bottles, and the like. The disposable sleeve shields a user holding the beverage container from condensation that may occur when a cold or cool beverage container encounters a warmer and/or more humid ambient environment and forms condensation. The disposable sleeve also provides a buffer from a cooler temperature of a beverage container. This is particularly advantageous in a social setting where a user holding a beverage container may wish to shake hands or touch another person, without the embarrassment of cold and/or wet hands and/or fingers.

The inventor has discovered a more economical template and process for producing a disposable beverage container sleeve. Furthermore, the inventor has surprisingly discovered a disposable beverage container sleeve that is stronger than the disposable wraps and sleeves of the prior art. Also, the inventor has surprisingly discovered that the disposable beverage container sleeve of the present invention can be produced with less waste and torn sleeves, as well as less adhesive, compared to the prior art.

Figure 2:
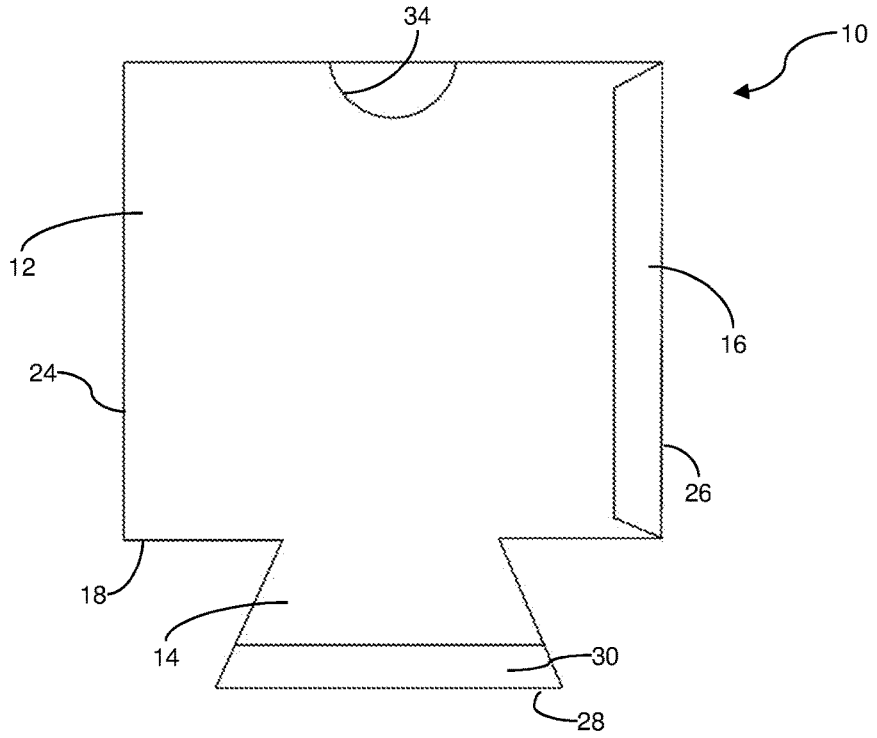
FIG. 2 is a side elevation view of one embodiment of a disposable sleeve for a beverage container.
Figure 3:
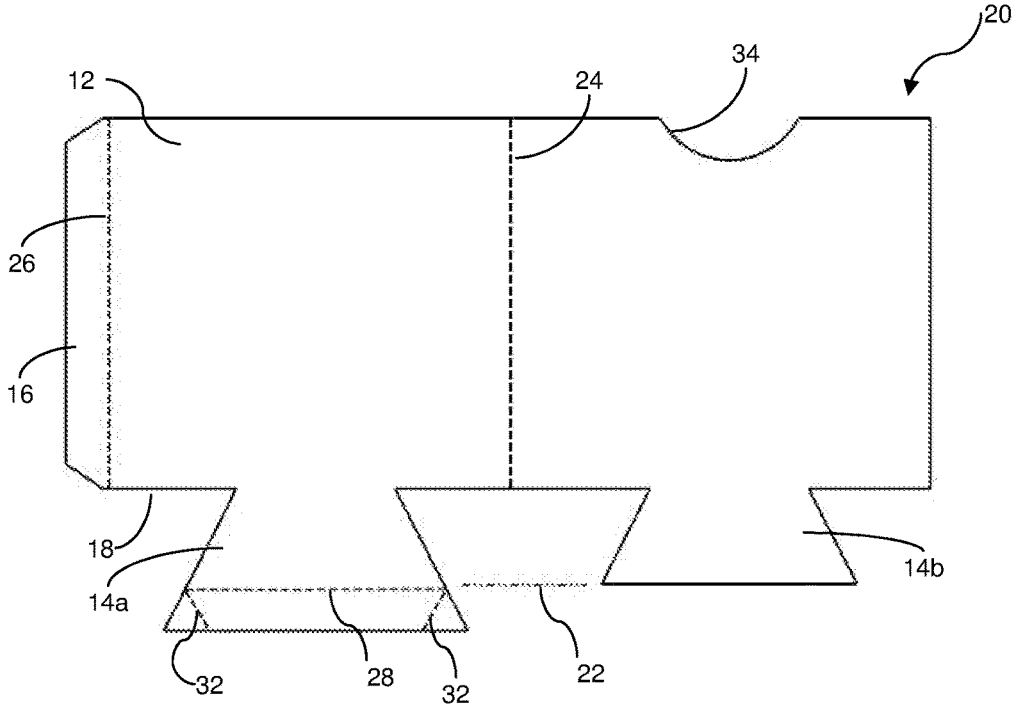
FIG. 3 is a top plan view of a workpiece prior to assembly for making the embodiment of the disposable sleeve of FIG. 2.

Referring now to the drawings of the present invention, FIG. 2 depicts one embodiment of a disposable sleeve 10 of the present invention for a beverage container, while FIG. 3 illustrates a workpiece 20 for making the disposable sleeve 10 of FIG. 2, prior to assembly.

The disposable sleeve 10 of FIG. 2 has an upper body 12 and a gusset 14 extending from one side of the upper body 12 to the other. The upper body 12 is substantially rectangular in shape and has an integrated flap 16 for affixing vertical sides of the upper body 12 together. The flap 16 shown in FIGS. 2 and 3 is trapezoidal in shape. It will be understood that other shapes are possible as discussed more fully below with respect to other embodiments of the disposable sleeve 10.

As shown more clearly in FIG. 3, although the workpiece 20 is a unitary structure, the gusset 14 is formed of two distinct gusset portions 14*a*, 14*b* extending from a lower edge 18 of the upper body 12. As shown in FIG. 3, first and second gusset portions 14*a*, 14*b* are trapezoidal in shape to result in a gusset 14 shown in FIG. 2 that is itself trapezoidal in shape.

The disposable sleeve 10 is advantageously produced from a paper. The selection of type of paper can be determined by the skilled in the art in view of a number of preferred characteristics including, without limitation, absorbency, strength, recyclability, texture, color, projected/desired number of uses before disposal, and the like, without departing from the spirit of the present invention. The paper may be a multi-ply or multi-layer paper in combination with foil, plastic, an adsorbent, and the like, without departing from the spirit of the present invention.

The workpiece 20 shown in FIG. 3 is assembled by folding the upper body 12 along vertical upper body fold line 24. The flap 16 is folded along flap fold line 26. The flap 16 is preferably affixed to the outer side of the upper body 12 with an adhesive, for example, with glue, in the form of dots or strips, an adhesive strip, double-sided tape and the like. It will be understood that the type of adhesive may be selected in view of the material of construction of the disposable sleeve 10, the manufacturing process, and the like, without departing from the spirit of the present invention. Other affixing processes may also be used without departing from the spirit of the present invention.

In the embodiment shown in FIGS. 2 and 3, a first gusset portion 14*a* is longer than a second gusset portion 14*b* (as more clearly illustrated by the dash-dot reference line 22 in FIG. 3). In this embodiment, the first gusset portion 14*a* is folded along first gusset fold line 28, and is preferably affixed to the outer side of the second gusset portion 14*b* with an adhesive, as discussed in the preceding paragraph.

Optionally, the first gusset portion 14*a* may be cut or folded along optional gusset cutting lines 32 to conform to the shape of the second gusset portion 14*b*.

In this manner, a gusset support band 30 is produced by one thickness of the first gusset portion 14*a* and one thickness of the second gusset portion 14*b*. In this case, the gusset support band 30 is on one side of a center line of the gusset 14 defined by first gusset fold line 28.

The upper body 12 preferably has a member allowing for ease of use, for example, when a server or user is picking the disposable sleeve 10 from a stack of disposable sleeves 10. In the embodiment shown in FIGS. 2 and 3, the member is an arcuate cut-out 34. It will be understood by those skilled in the art that other shapes for the cut-out are also possible, without departing from the spirit of the present invention.

Figure 4:
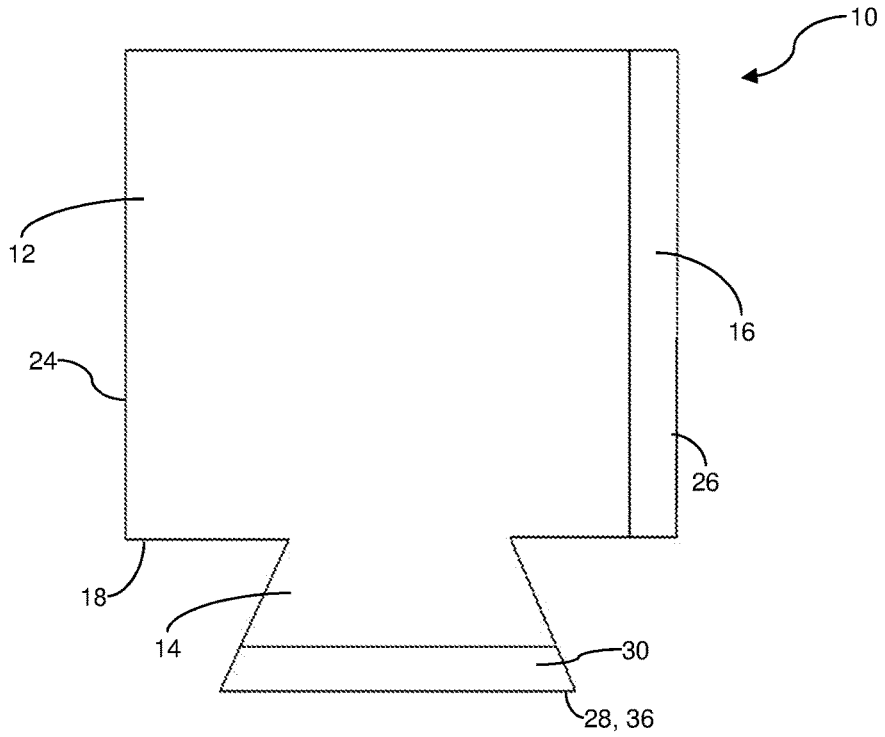
FIG. 4 is a side elevation view of another embodiment of a disposable sleeve for a beverage container.
Figure 5:
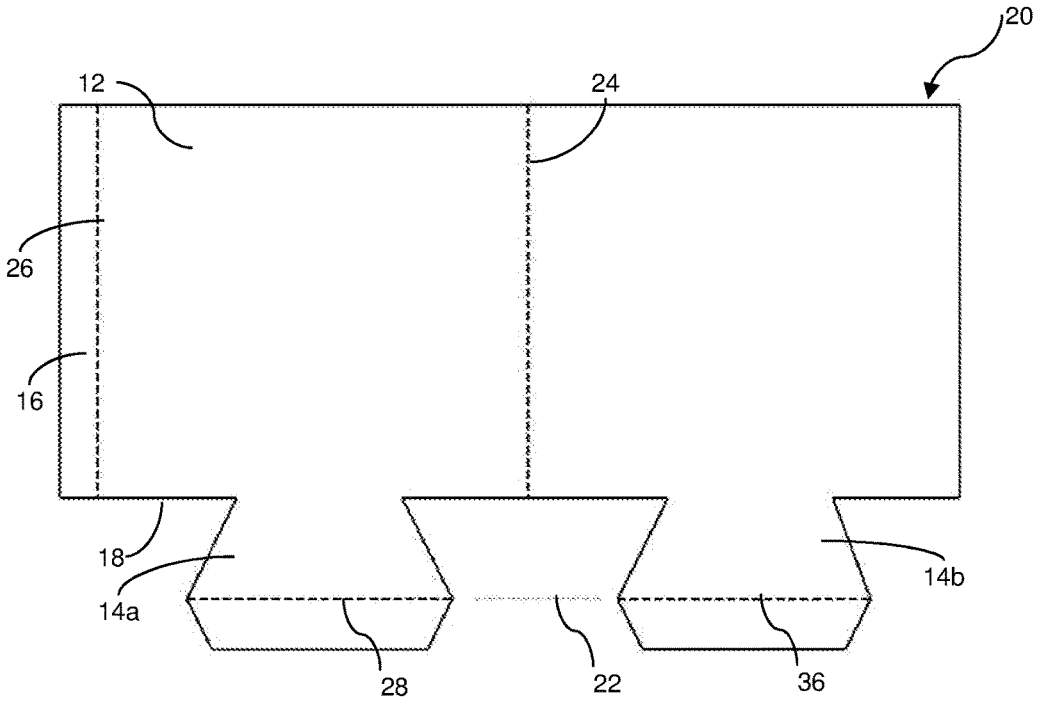
FIG. 5 is a top plan view of a workpiece prior to assembly for making the embodiment of the disposable sleeve of FIG. 4.

FIG. 4 depicts another embodiment of a disposable sleeve 10 of the present invention for a beverage container, while FIG. 5 illustrates a workpiece 20 for making the disposable sleeve 10 of FIG. 4, prior to assembly.

As in FIG. 2, the disposable sleeve 10 of FIG. 4 has an upper body 12 and a gusset 14 extending from one side of the upper body 12 to the other. The upper body 12 is substantially rectangular in shape and has an integrated flap 16 for affixing vertical sides of the upper body 12 together. The flap 16 shown in FIGS. 4 and 5 is rectangular in shape.

As shown more clearly in FIG. 5, although the workpiece 20 is a unitary structure, the gusset 14 is formed of two distinct gusset portions 14*a*, 14*b* extending from a lower edge 18 of the upper body 12. As shown in FIG. 5, first and second gusset portions 14*a*, 14*b* are an irregular hexagon in shape to result in a gusset 14 shown in FIG. 4 that is itself trapezoidal in shape.

The workpiece 20 shown in FIG. 5 is assembled by folding the upper body 12 along vertical upper body fold line 24. The flap 16 is folded along flap fold line 26 and affixed to the outer side of the upper body 12, as discussed above in connection with the workpiece of FIG. 3.

In the embodiment shown in FIGS. 4 and 5, first and second gusset portions 14*a*, 14*b* are substantially equal in size and shape (as highlighted by the dash-dot reference line 22 in FIG. 5). In this embodiment, first gusset portion 14*a* is folded along gusset fold line 28 and is affixed to the inner side of second gusset portion 14*b*, while second gusset portion 14*b* is folded along gusset fold line 36 and is affixed to the outside of first gusset portion 14*a*. It will be understood that the arrangement of folding and affixing may be reversed without departing from the spirit of the present invention.

In this manner, a gusset support band 30 is produced by one thickness of the first gusset portion 14*a* and one thickness of the second gusset portion 14*b*. In this case, the gusset support band 30 is substantially center about a center line of the gusset 14 defined by the gusset fold lines 28, 36.

Alternatively, the workpiece 20 of FIG. 5 may be folded to form the gusset support band by affixing the folded portion of the first gusset portion 14*a* to the folded portion of the second gusset portion 14*b*, and then affixing the folded and affixed folded portions to one of the first gusset portion and the second gusset portion.

In this manner, a gusset support band 30 is produced by two thicknesses of the first gusset portion 14*a* and one thickness of the second gusset portion 14*b*, or by two thicknesses of the second gusset portion 14*b* and one thickness of the first gusset portion 14*a*. In this case, the gusset support band 30 is on one side of a center line of the gusset 14 defined by the gusset fold lines 28, 36.

Figure 6:
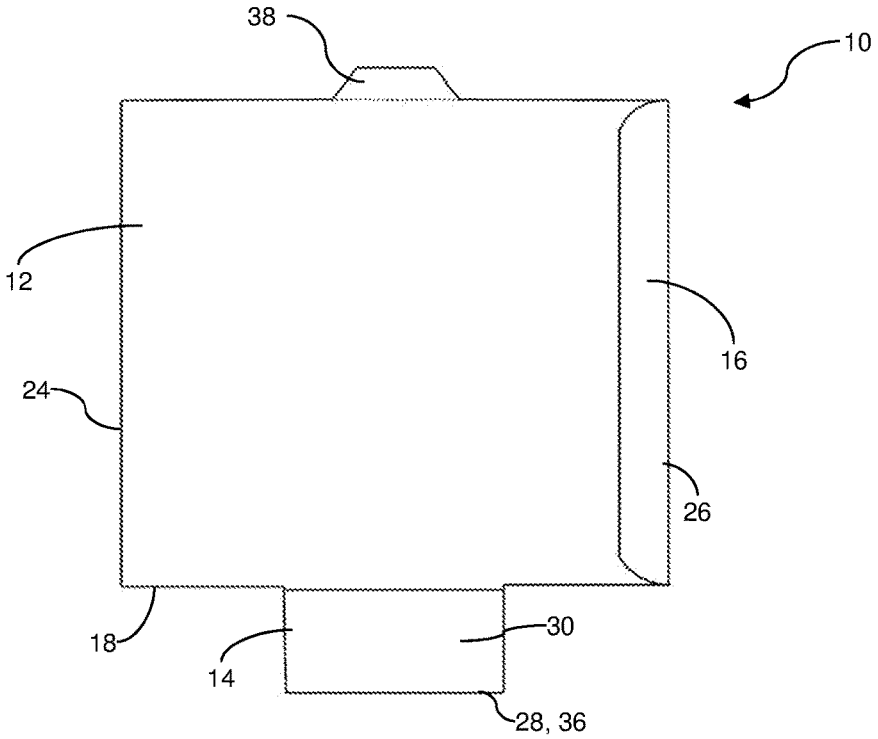
FIG. 6 is a side elevation view of a further embodiment of a disposable sleeve for a beverage container.
Figure 7:
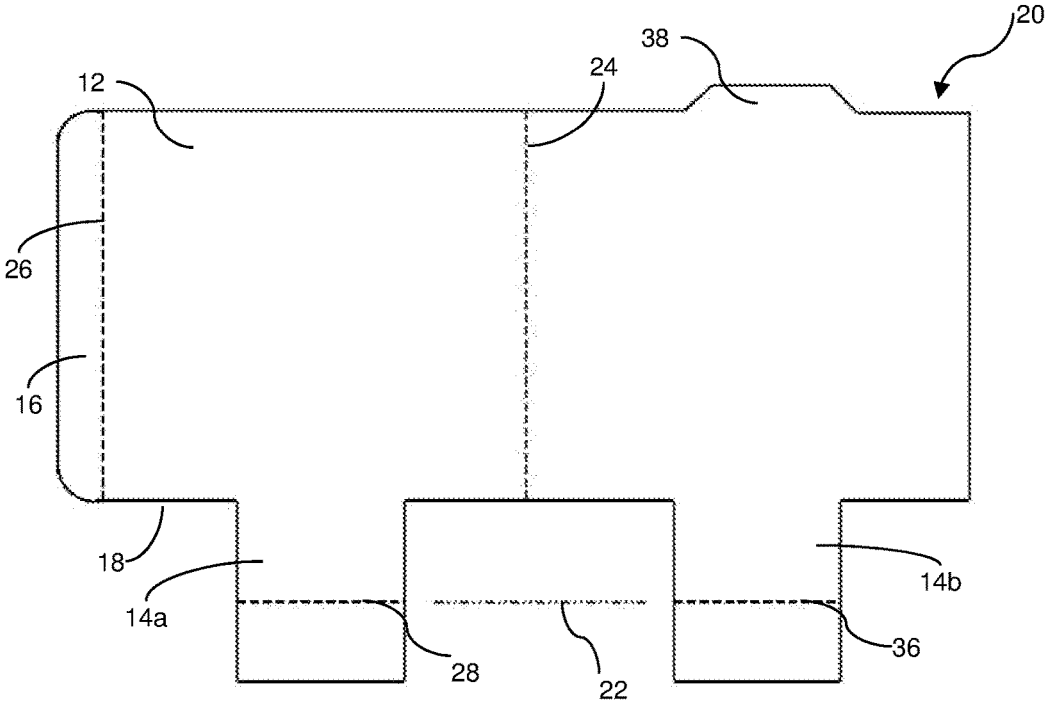
FIG. 7 is a top plan view of a workpiece prior to assembly for making the embodiment of the disposable sleeve of FIG. 6.

Referring now FIGS. 6 and 7, FIG. 6 depicts a further embodiment of a disposable sleeve 10 of the present invention for a beverage container, while FIG. 7 illustrates a workpiece 20 for making the disposable sleeve 10 of FIG. 6, prior to assembly.

The disposable sleeve 10 of FIG. 6 has an upper body 12 and a gusset 14 extending from one side of the upper body 12 to the other. The upper body 12 is substantially rectangular in shape and has an integrated flap 16 for affixing vertical sides of the upper body 12 together. The flap 16 shown in FIGS. 6 and 7 is generally rectangular in shape, with rounded corners.

As shown more clearly in FIG. 7, although the workpiece 20 is a unitary structure, the gusset 14 is formed of two distinct gusset portions 14*a*, 14*b* extending from a lower edge 18 of the upper body 12. As shown in FIG. 7, first and second gusset portion 14*a*, 14*b* are rectangular in shape to result in a gusset 14 shown in FIG. 6 that is itself rectangular in shape.

The workpiece 20 shown in FIG. 7 is assembled by folding the upper body 12 along vertical upper body fold line 24. The flap 16 is folded along flap fold line 26. The flap 16 is preferably affixed to the outer side of the upper body 12, as described above in connection with the embodiment shown in FIGS. 2 and 3.

In the embodiment shown in FIGS. 6 and 7, first and second gusset portions 14*a*, 14*b* are substantially the same shape and length (as highlighted by the dash-dot reference line 22 in FIG. 7). In this embodiment, first gusset portion 14*a* is folded along gusset fold line 28 and is affixed to the inner side of second gusset portion 14*b*, while second gusset portion 14*b* is folded along gusset fold line 36 and is affixed to the outside of first gusset portion 14*a*. It will be understood that the arrangement of folding and affixing may be reversed without departing from the spirit of the present invention.

In this manner, a gusset support band 30 is produced by one thickness of the first gusset portion 14*a* and one thickness of the second gusset portion 14*b*. In this case, the gusset support band 30 is substantially center about a center line of the gusset 14 defined by the gusset fold lines 28, 36.

As mentioned above, the upper body 12 preferably has a member allowing for ease of use, for example, when a server or user is picking the disposable sleeve 10 from a stack of disposable sleeves 10. In the embodiment shown in FIGS. 6 and 7, the member is a trapezoidal tab 38. It will be understood by those skilled in the art that other shapes for the tab are also possible, without departing from the spirit of the present invention.

Various embodiments of the gusset shape and size, upper body flap shape and presence and shape of a member for picking up the disposable beverage container sleeve are depicted in FIGS. 2 through 7. It will be understood that each embodiment of the disposable sleeve 10 of the present invention can be adapted to use embodiments of explained herein, as well as adaptations that a person of ordinary skill in the art can derive from the drawings and discussion herein.

Figure 8:
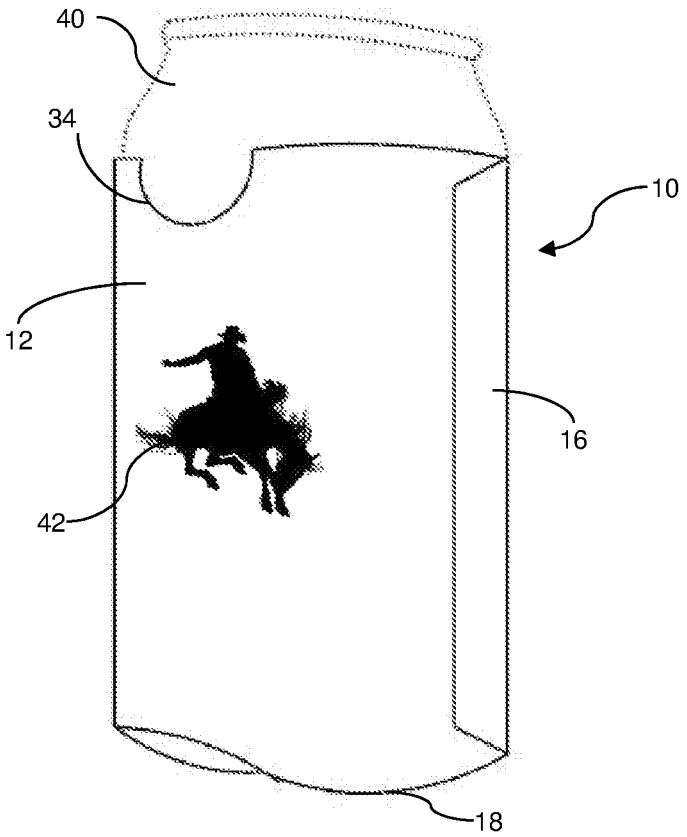
FIG. 8 is a perspective view of the disposable sleeve for a beverage container of FIG. 2 in use around a beverage can.
Figure 9:
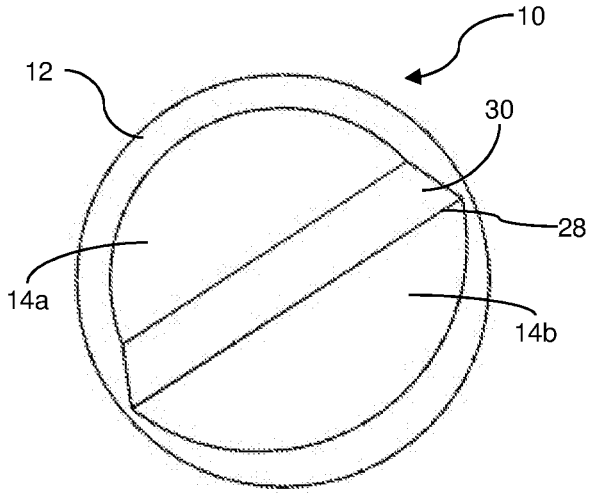
FIG. 9 is a bottom plan view of the disposable sleeve for a beverage container of FIG. 2 in use around a beverage can.

FIGS. 8 and 9 illustrate the FIG. 2 embodiment of the disposable beverage container sleeve 10 in use around a beverage can 40. In the embodiment shown in FIG. 8, the disposable beverage container sleeve 10 further comprises a marketing logo 40 incorporated in or on the upper body 12. The marketing logo 40 may be selected from the group consisting of logos symbolizing an event, an association, an organization, a team, a school, a manufacturer, a producer, a supplier, a purveyor, a cause, goods made or sold by a manufacturer, a producer, a supplier, or a purveyor, and services provided by a manufacturer, a producer, a supplier, or a purveyor, and combinations thereof. The marketing logo 40 may be incorporated in or on the upper body by imprinting, stamping, embossing, affixing a label, and combinations thereof. Various inks may be used depending on the material of construction and desired effect. For example, it may be preferred to use an ink that will not bleed or come off on the user's or server's hands. It may also be desirable to select an ink that changes color or becomes visible in response to temperature or humidity.

Advantageously, the disposable beverage container sleeve 10 of the present invention can accommodate different diameter beverage containers, for example ranging in diameter from 2.25 inches to 2.75 inches. The disposable beverage container sleeve 10 may be sized to accommodate only one size of beverage container, or sized to accommodate a majority of beverage container sizes. With the materials of construction provided herein, the disposable beverage container sleeve 10 may be shaped by the user or server around various configurations and diameters of beverage containers without much effort, simply by gripping the beverage container encased in the disposable beverage container sleeve 10 of the present invention.

Figure 10:
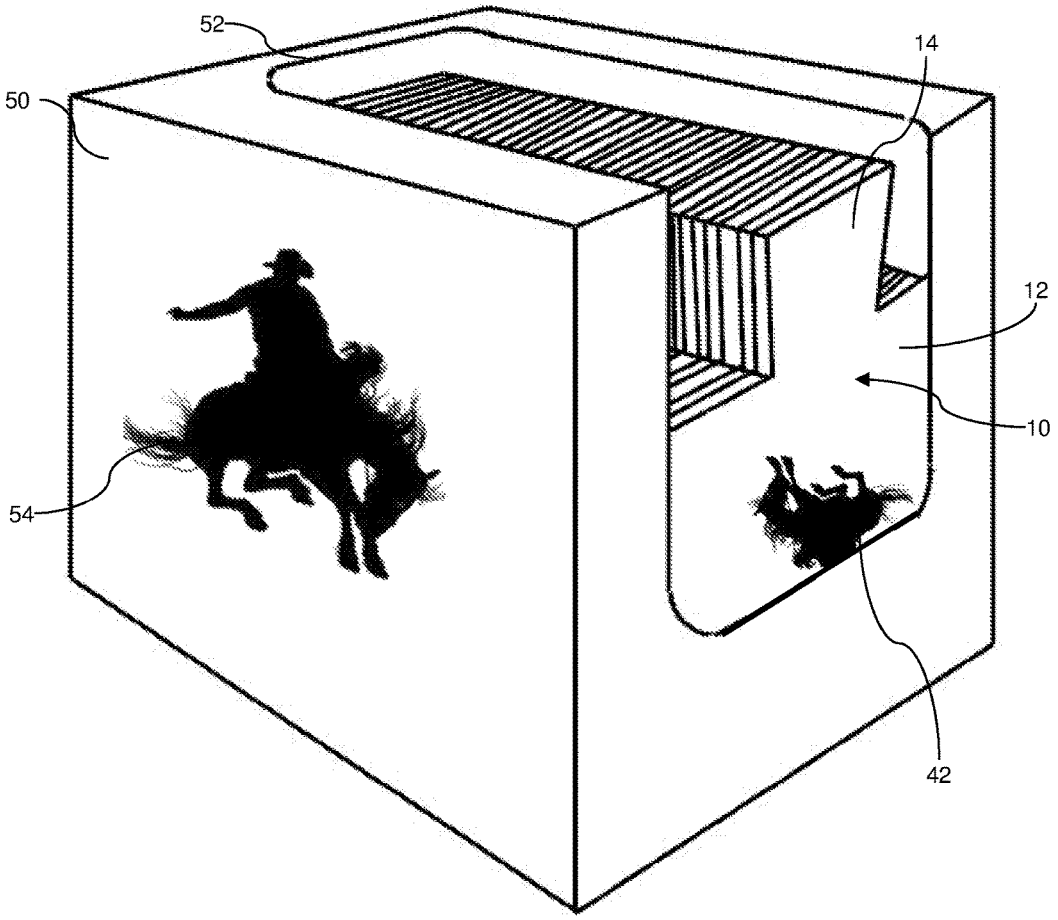
FIG. 10 is a perspective view of one embodiment of a dispenser for the disposable sleeve for a beverage container of FIG. 2.

Finally, FIG. 10 illustrates an embodiment of a dispenser 50 for dispensing the disposable beverage container sleeves 10 of the present invention. In the embodiment of the dispenser 50 shown in FIG. 10, the desired number of beverage container sleeves 10 are packaged in the dispenser 50, so that the disposable beverage container sleeves 10 are presented upside down at the point of use. A user or server simply selects a disposable beverage container sleeve 10 by pulling on the gusset 14.

The embodiment of the dispenser 50 shown in FIG. 10 is made of cardboard and can be used to package, ship and deliver the disposable beverage container sleeves 10 to the point of use. A perforated section 52 allows for a portion of the dispenser 50, not shown, to be removed for display and use. The dispenser 50 may be provided with a dispenser marketing logo 54 corresponding to the marketing logo 42 incorporated in or on the disposable beverage container sleeve 10.

However, it will be understood that other dispenser configurations may be used to dispense the disposable beverage container sleeves 10 of the present invention, and that other materials of construction, whether disposable or not, may be used for a dispenser. In any case, the use of a dispenser is optional.

While preferred embodiments of the present disclosure have been described, it should be understood that other various changes, adaptations and modifications can be made therein without departing from the spirit of the invention(s) and the scope of the appended claims. The scope of the present disclosure should, therefore, be determined not with reference to the above description, but instead should be determined with reference to the appended claims along with their full scope of equivalents. Furthermore, it should be understood that the appended claims do not necessarily comprise the broadest scope of the invention(s) that the applicant is entitled to claim, or the only manner(s) in which the invention(s) may be claimed, or that all recited features are necessary.

I claim:

1. A disposable beverage container sleeve, comprising:

a substantially rectangular upper body having a vertical upper body fold line and an integrated upper body flap along a full length of a first vertical edge of the upper body, the upper body flap adapted to fold over a second vertical edge of the upper body, the upper body flap further adapted to be affixed to the upper body proximate the second vertical edge;

a gusset comprising a first gusset portion and a second gusset portion, the first and second gusset portions integrated with and depending from a lower edge of the upper body on opposing sides of the vertical upper body fold line;

wherein the gusset further comprises a gusset support band formed by at least one thickness of the first gusset portion and at least one thickness of the second gusset portion;

whereby, when the upper body flap is affixed to the upper body proximate the second vertical edge and the gusset support band is formed, the disposable beverage container sleeve is laterally continuous from the first vertical edge of the upper body to the vertical upper body fold line to the second vertical edge of the upper body, and longitudinally continuous from an upper edge of the upper body to the lower edge of the upper body through the first gusset portion to the gusset support band through the second gusset portion to the lower edge of the upper body to the upper edge of the upper body.

2. The disposable beverage container sleeve of claim 1, wherein the gusset support band is integrated with and depends from a lower edge of the first gusset portion, and the gusset is formed by folding the gusset support band over a lower edge of the second gusset portion and affixing the gusset portion gusset support band to the second gusset portion, thereby connecting the lower edge of the first gusset portion to the lower edge of the second gusset portion.

3. The disposable beverage container sleeve of claim 2, wherein the gusset support band is affixed to the second gusset portion with an adhesive.

4. The disposable beverage container sleeve of claim 1, wherein the gusset support band further comprises a first gusset support portion integrated with and depending from a lower edge of the first gusset portion and a second gusset support portion integrated with and depending from a lower edge of the second gusset portion, and the gusset is formed by affixing the first gusset support portion to the second gusset portion, and affixing the second gusset support portion to the first gusset portion, thereby connecting the lower edge of the first gusset portion to the lower edge of the second gusset portion.

5. The disposable beverage container sleeve of claim 4, wherein the first gusset support portion and the second gusset support portion are affixed with an adhesive.

6. The disposable beverage container sleeve of claim 1, wherein the gusset support band further comprises a first gusset support portion integrated with and depending from a lower edge of the first gusset portion and a second gusset support portion integrated with and depending from a lower edge of the second gusset portion and the gusset is formed by affixing the first gusset support portion to the second gusset support portion, and affixing the first gusset support portion to the first gusset portion, thereby connecting the lower edge of the first gusset portion to the lower edge of the second gusset portion.

7. The disposable beverage container sleeve of claim 6, wherein the first gusset support portion and the second gusset support portion are affixed with an adhesive.

8. The disposable beverage container sleeve of claim 1, further comprising a member for picking up the disposable beverage container sleeve from a stack of the disposable beverage container sleeves.

9. The disposable beverage container sleeve of claim 8, wherein the member for picking up the disposable beverage container sleeve is selected from the group consisting of a cut-out on the upper edge of the upper body, a tab extending from the upper edge of the upper body, and combinations thereof.

10. The disposable beverage container sleeve of claim 1, wherein the upper body flap is affixed to the upper body with an adhesive.

11. The disposable beverage container sleeve of claim 1, wherein the upper body, the upper body flap, the first gusset portion and the second gusset portion are provided in a unitary structure.

12. The disposable beverage container sleeve of claim 11, wherein the unitary structure is formed from a paper-based product.

13. The disposable beverage container sleeve of claim 12, wherein the paper-based product is selected from multi-ply and multi-layer paper-based product.

14. The disposable beverage container sleeve of claim 12, wherein the paper-based product further comprises plastic, foil, adsorbent, and combinations thereof.

15. The disposable beverage container sleeve of claim 1, further comprising a marketing logo incorporated in or on the upper body, the marketing logo selected from the group consisting of logos symbolizing an event, an association, an organization, a team, a school, a manufacturer, a producer, a supplier, a purveyor, a cause, goods made or sold by a manufacturer, a producer, a supplier, or a purveyor, and services provided by a manufacturer, a producer, a supplier, or a purveyor, and combinations thereof.

16. The disposable beverage container sleeve of claim 15, wherein the marketing logo is incorporated in or on the upper body by a process selected from the group consisting of imprinting, stamping, embossing, affixing a label, and combinations thereof.

17. The disposable beverage container sleeve of claim 1, further comprising a dispenser for a plurality of the disposable beverage container sleeves, the dispenser adaptable to at least one of packaging, shipping, and delivering the disposable beverage container sleeves to a point of use.

* * * * *